US006130527A

United States Patent [19]

Bontempo et al.

[11] Patent Number: 6,130,527

[45] Date of Patent: Oct. 10, 2000

[54] VOLTAGE REGULATION CIRCUIT

[75] Inventors: Gregorio Bontempo, Barcellona; Francesco Pulvirenti, Acireale, both of Italy

[73] Assignee: STMicroelectronics S.r.l., Agrate Brianza, Italy

[21] Appl. No.: 09/378,171

[22] Filed: Aug. 20, 1999

[30] Foreign Application Priority Data

Aug. 31, 1998 [IT] Italy ..... MI98A1941

[51] Int. Cl.[7] ..... G05F 1/40

[52] U.S. Cl. ..... 323/280

[58] Field of Search ..... 323/273, 274, 323/280, 281

[56] References Cited

U.S. PATENT DOCUMENTS 5,774,021 6/1998 Szepesi et al. ..... 323/280

*Primary Examiner*—Shawn Riley

*Attorney, Agent, or Firm*—Theodore E. Galanthay; E. Russell Tarleton; Seed IP Law Group PLLC

[57] ABSTRACT

A voltage regulator providing smooth variation of an absorbed current having a first capacitor parallel-connected to a load, which is in turn connected to a supply voltage; a transconductor coupled between the supply voltage and the load and whose output voltage supplies the load; a differential amplifier coupled between the output of the transconductor and the supply voltage, and further coupled to the input of the transconductor, a second capacitor coupled between the supply voltage and the input of the transconductor; and a pair of diodes coupled between the output of the transconductor and the first capacitor and configured to introduce a zero in the transfer function of the voltage regulator that is suitable to compensate for a pole generated by the first capacitor.

15 Claims, 2 Drawing Sheets

VOLTAGE REGULATION CIRCUIT

TECHNICAL FIELD

The present invention relates to a voltage regulation circuit having a smooth variation of absorbed current.

BACKGROUND OF THE INVENTION

It is known that the simplest circuit solution for insulating a load from the power supply source is to arrange an inductor in series with the power supply in order to avoid sudden current variations, and a capacitor in parallel to the load, using said capacitor to store electrical charges, as shown in FIG. 1.

As shown in FIG. 1, $V_{dc}$ is the line supply voltage, L is the insulating inductor, C is the filtering capacitor, R is the resistor that represents the loss of the components, $I_L$ and δI are the static and dynamic currents of the load, and $V_{out}$ is the supply voltage of the load.

Circuit analysis can be performed by considering the second-order differential equation that represents the circuit. The two solutions of the equation represent the natural frequencies of the network, and in the case of over-damping the two frequencies are real and negative, the response of the network being the sum of two decreasing exponential values.

The physical interpretation of the solutions of the differential equation that represents the circuit of FIG. 1 is as follows. In static conditions, the current of the load $I_L$ flows across the inductor L, while the capacitor C is charged at the voltage $V_{out}=V_{dc}$. When a source of a current δI is applied, the voltage across the capacitor and the current on the inductor cannot change instantly and therefore all the current δI is supplied by the capacitor, causing a gradual decrease in the voltage $V_{out}$. The voltage variation then causes current to flow in the inductor. After a long time, the network reaches a new equilibrium, in which all the current flows in the inductor $I_L+\delta I$ and the voltage returns to the value $V_{out}=V_{dc}$.

The slew rate of the current in the inductor L has the following approximate value:

$$\text{Slew Rate} = \frac{\delta I_L}{\delta T} = \frac{R}{L}\delta I \qquad \text{(EQ 1)}$$

The above equation shows that the slew rate is inversely proportional to L and that in order to have low slew rate values it is necessary to use large inductors, on the order of 10 mH-1H, with a considerable area occupation on printed circuit boards.

Accordingly, integrated electronic circuits have been studied and produced which are capable of replacing the inductors while maintaining the same electrical performance as said inductors.

One known circuit solution is shown in FIG. 2, in which the block shown in dashed lines is circuitally equivalent to the inductor L of FIG. 1.

In FIG. 2, the capacitor $C_1$ acts as a charge accumulator and has the same function as the capacitor C of the circuit of FIG. 1.

The inductor L shown in FIG. 1, which is meant to control the variation in the current absorbed from the power supply, is provided, in FIG. 2, by two transconductors $G_1$ and $G_2$, by the differential amplifier $A_1$, by the resistors R, $R_1$ and by the capacitor $C_2$.

The resistor $R_L$ represents the resistance of the load and can vary its value suddenly.

As shown, the circuit of FIG. 2 is constituted by two negative-feedback loops: one is a voltage loop, which sets the voltage across the node $V_{c1}$ to the value $V_{reg}$, and the other one is a current loop, which sets the current supplied by the transconductor $G_1$ to the value defined by the load.

The voltage loop provides $V_{out}$:

$$V_{out}=V_{reg}-R\cdot I_L \qquad \text{(EQ 2)}$$

The current loop provides the current $I_{out}$:

$$I_{out}=I_L\cdot gm_1\cdot R\cdot gm_2\cdot R_1 \qquad \text{(EQ 3)}$$

If $gm_1=R^{-1}$ and $gm_2=R_1^{-1}$, one obtains $I_{out}=I_L$.

The slew rate $\Delta I_{out}/\Delta t$ can be calculated assuming a sudden variation in the current of the load.

If at a certain instant the current $I_L$ varies by the amount $\Delta I_L$, at the output of the transconductor $G_2$ one obtains a current $\Delta I_{sense}=R^*\Delta I_L{}^*gm_2$ supplied to the capacitor $C_2$ and the voltage $V_{c2}$ varies according to the following rule:

$$\frac{\Delta V_{C_2}}{\Delta T} = \frac{\Delta I_{sense}}{C_2} = \frac{R\cdot\Delta I_L\cdot gm_2}{C_2} \qquad \text{(EQ 4)}$$

providing in output from the block $G_1$ a current variation equal to:

$$\frac{\Delta I_{out}}{\Delta T} = \frac{\Delta V_{C_2}}{\Delta T}\cdot gm_1 = \frac{R\cdot\Delta I_2\cdot gm_2\cdot gm_1}{C_2} \qquad \text{(EQ 5)}$$

In view of the choices made for $gm_1$ and $gm_2$, i.e., the transconductances of the transconductors $G_1$ and $G_2$ respectively, the following relation is derived:

$$\frac{\Delta I_{out}}{\Delta T} = \frac{\Delta I_L}{R_1\cdot C_2} \qquad \text{(EQ 6)}$$

Once the resistor $R_1$ is defined, the slew rate is a function of the current variation of the load $\Delta I_L$ and of the value of the capacitor $C_2$.

Once the capacitor $C_1$ is defined, the capacitor $C_2$ is chosen so as to ensure the stability of the two feedback loops.

Small-signal analysis of the circuit of FIG. 2 shows that there are two poles, due to the presence of the two capacitors, whose pulses are:

$$\omega_1 = \frac{1}{(R_L+R)\cdot C_1} \qquad \omega 2 = \frac{1}{(R_1\cdot C_2)} \qquad \text{(EQ 7)}$$

In general, $R_L$ is much higher than R but lower than $R_1$, while $C_1$ is higher than $C_2$ and this can cause instability of the network. In order to avoid oscillation problems, the gain of the loop is lowered so as to obtain an acceptable phase margin (mϕ=30°−40°). This is achieved by reducing the gain of the differential amplifier $A_1$.

Therefore, the known circuit shown in FIG. 2 has drawbacks which limit its use.

First of all, the precision of the DC output current depends on the construction of the blocks $G_1$ and $G_2$ and on the coupling of the resistors R and $R_1$.

The slew rate is a function of the load and of the capacitor $C_2$.

Moreover, the value of the voltage $V_{out}$ (set to the voltage $V_{c1}$) is a function of the current of the load. The choice of the capacitors $C_1$ and $C_2$ must be such as to not trigger oscillations in the network. Finally, the gain of the differential amplifier $A_1$ must be chosen as a function of the optimum phase margin.

SUMMARY OF THE INVENTION

The aim of the present invention is to provide a voltage regulator with smooth variation of the absorbed current which enables considerable reduction in the complexity of the circuit.

Within the scope of this aim, the invention provides a voltage regulator with smooth variation of the absorbed current whose output current precision is independent of the construction of the transconductors that constitute the inductor of the circuit.

The invention also provides a voltage regulator with smooth variation of the absorbed current in which the slew rate of the output current depends exclusively on the capacitor $C_2$.

The invention further provides a voltage regulator with smooth variation of the absorbed current in which the output voltage is regulated and measured directly on the load, and with smooth variation of the absorbed current which is inherently stable.

The invention also provides a voltage regulator with smooth variation of the absorbed current which is highly reliable, and is relatively easy to manufacture and at competitive costs.

This voltage regulator having a smooth variation of the absorbed current includes:

first capacitive means which are parallel-connected to a load which is in turn connected to a supply voltage;

a transconductor which is interposed between said supply voltage and said load and whose output voltage supplies said load;

differential amplifier means which are connected between the output of said transconductor and the supply voltage, and the input of said transconductor, second capacitive means being connected between said supply voltage and the input of said transconductor; and a pair of diodes interposed between the output of said transconductor and said first capacitive means, in order to introduce a zero in the transfer function of said voltage regulator which is suitable to compensate for the pole generated by said first capacitive means.

BRIEF DESCRIPTION OF THE DRAWINGS

Further characteristics and advantages of the present invention will become apparent from the following detailed description of a preferred embodiment of the regulator according to the invention, illustrated only by way of non-limitative example in the accompanying drawings, wherein.

DETAILED DESCRIPTION OF THE INVENTION

Figure 1:
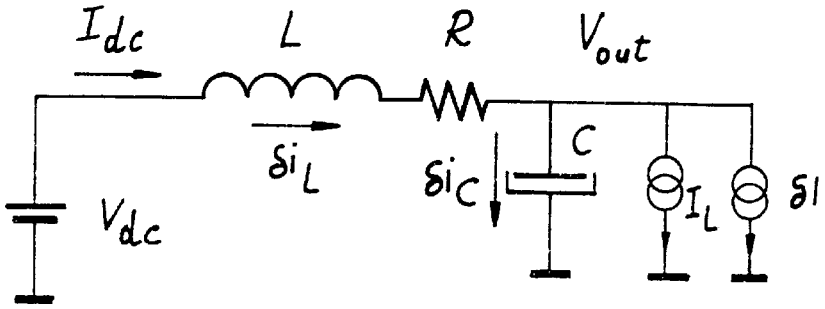
FIG. 1 (PRIOR ART)
FIG. 1 is a conceptual circuit diagram of the insulation of a load from the power supply.

With reference to the above figures, in which identical reference numerals designate identical elements, the voltage regulator according to the invention is as follows.

Figure 2:
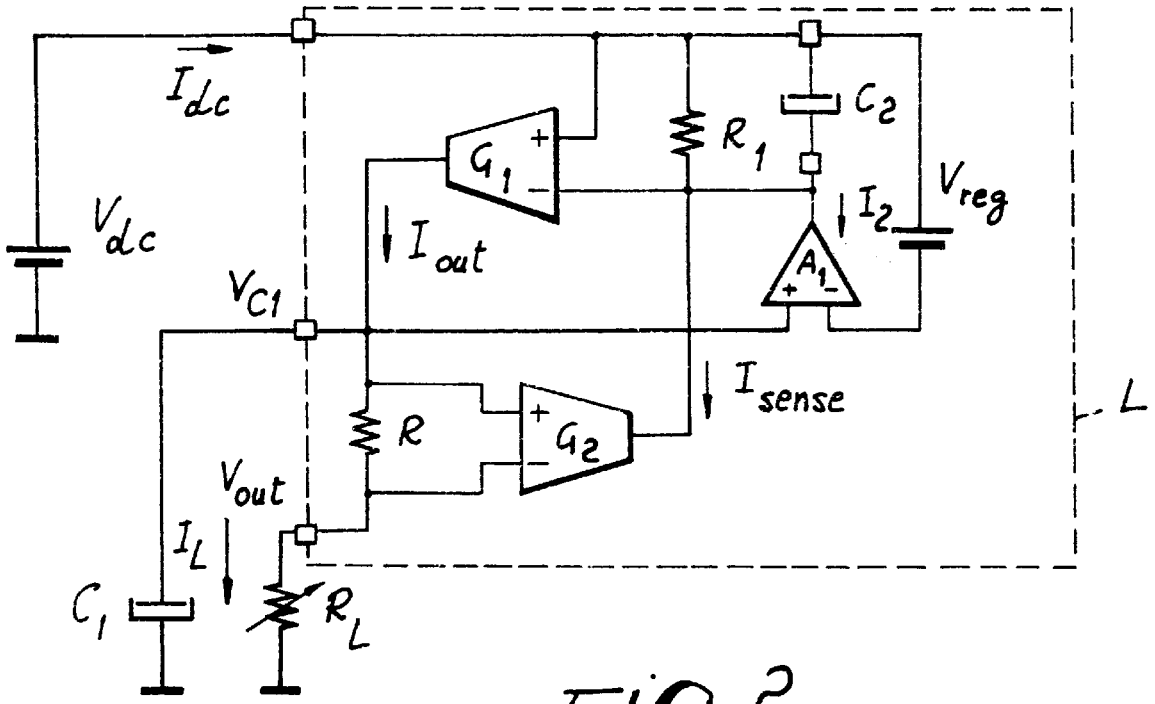
FIG. 2 (PRIOR ART)
FIG. 2 is a circuit diagram of a conventional type of voltage regulator.

It is noted that the description of FIGS. 1 and 2 is not continued here for the sake of brevity since it has already been given.

Figure 3:
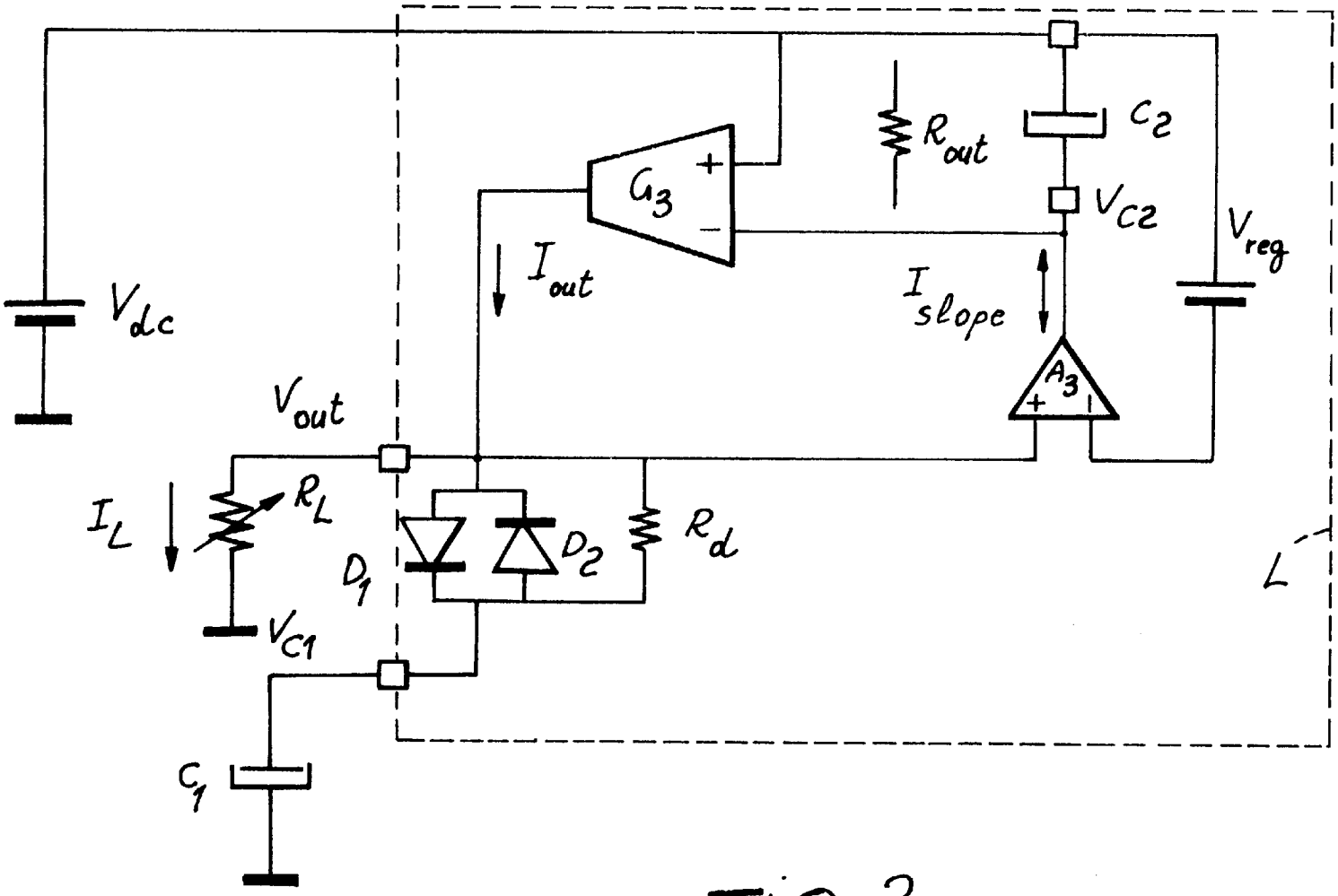
FIG. 3 is a circuit diagram of a voltage regulator according to the present invention.

Accordingly with reference to FIG. 3, the device according to the invention introduces a singularity (a zero) which is capable of perfectly canceling out the pole related to the capacitor $C_1$, making the circuit inherently stable and at the same time producing a voltage $V_{out}$ which is perfectly regulated and independent of the load.

FIG. 3 is a conceptual diagram of the regulator according to the invention.

In such figure, as in the above-described FIG. 2, the portion shown in dashed lines corresponds to the inductor L shown in the circuit of FIG. 1, which is meant to insulate the load from the supply voltage.

The output voltage $V_{out}$ is the supply voltage of the load.

In FIG. 3, the capacitors $C_1$ and $C_2$ are the same as in FIG. 2 and the transconductor $G_3$ is similar to the transconductor $G_1$ and has a transconductance value $gm_3$. The transconductor $G_3$ supplies the current to the load.

The reference sign $A_3$ designates a high-gain differential amplifier with a limited output current $I_{slope}$; $R_{out}$ is the equivalent output resistance of the differential amplifier; and $D_1$ and $D_2$ are two diodes meant to introduce the intended zero, while $R_d$ is their equivalent resistance in the off state.

The two diodes are mutually parallel-connected between the output of the transconductor $G_3$ and the node $V_{c1}$ of the circuit.

The resistance $R_L$ represents, as mentioned with reference to FIG. 2, the resistance of the load and can vary its value suddenly.

Since the input impedance of the differential amplifier $A_3$ and of the transconductor $G_3$ is very high (theoretically infinite), and in view of the high gain of the feedback network, the voltage $V_{out}$ reaches the value $V_{reg}$ and the current supplied by the transconductor $G_3$ must be equal to the current of the load (i.e., $I_{out}=I_L$). A transient analysis is now performed. If a current $\Delta I_L$ is superimposed on the current $I_L$ that flows across the resistor $R_L$, the voltage $V_{out}$ rapidly decreases until the capacitor $C_1$ delivers the same current across the diode $D_2$ ($D_1$). This variation causes the complete unbalancing of the differential amplifier $A_3$, obtaining in output a current $\Delta I_{slope}$. This current varies the voltage across the capacitor $C_2$ in a controlled manner according to the following relation:

$$\frac{\Delta V_{c2}}{\Delta T} \cdot \frac{\Delta I_{slope}}{C_2} \qquad \text{(EQ 8)}$$

This voltage variation across the capacitor $C_2$ is matched by a current variation which is equal to:

$$\frac{\Delta I_{ou}}{\Delta T} = \frac{\Delta V_{c2}}{\Delta T} \cdot gm_3 = \frac{\Delta I_{slope}}{C_2} \cdot gm_3 \qquad \text{(EQ 9)}$$

If $Gm_3=R^{-I}$ and $I_{slope}=I_L/n$, one obtains the same result as in the known circuit shown in FIG. 2.

As regards stability analysis, the dynamic circuit obtained from the circuit of FIG. 3 has two poles and a zero which are determined by two capacitors $C_1$ and $C_2$, whose pulses are:

$$\omega_1 = \frac{1}{(R_d + R_L) \cdot C_1} \quad \omega_z = \frac{1}{R_d \cdot C_1} \quad \omega_2 = \frac{1}{R_{out} \cdot C_2}$$

In the steady state, the diodes $D_1$ and $D_2$ operate in the off region, so that the equivalent resistance $R_d$ becomes very high and is much higher than the resistance $R_L$, so that the pole $\omega_1$ and the zero $\omega_z$ become equal and cancel each other out.

To conclude, the circuit has a single pole determined by the capacitor $C_2$ at the pulse $\omega_2$ and therefore (according to fedback circuit stability theory) it is inherently stable regardless of the gain of the loop.

In practice it has been found that the voltage regulator with smooth variation of the absorbed current provided according to the present invention fully achieves the intended aim and objects, since it provides reduced complexity with respect to the known circuit, output current precision regardless of the execution of the transconductor and of the differential amplifier, a slew rate for the output current that depends exclusively on the capacitor $C_2$, and it is inherently stable by virtue of the presence of an additional zero with respect to the circuit of FIG. 2.

The voltage regulator thus conceived is susceptible of numerous modifications and variations, all of which are within the scope of the inventive concept; all the details may also be replaced with other technically equivalent elements.

The device according to the invention can be used, for example, as a voltage regulator for sensors or actuators which, due to sudden variations in current due to their activation, must be insulated from the power supply line by means of the regulator.

This reduces the current variation due to activation of the sensors or actuators, which can introduce voltage or current variations in the network which can affect correct communication between the sensors and the actuators.

A typical application of a sensor and an actuator could be to keep the temperature constant in a room, thus using two devices arranged so as to mutually communicate. One of them is used as a temperature sensor in order to monitor the temperature of the room, while the other one is used as an actuator in order to switch on and off the boiler or conditioner, which is physically located elsewhere.

The voltage regulator allows to supply the above-described sensors and actuators, absorbing a supply current which has a controlled slew rate.

The disclosures in Italian Patent Application No. MI198A001941 from which this application claims priority are incorporated herein by reference.

What is claimed is:

1. A voltage regulator circuit with smooth variation of an absorbed current, comprising:

first capacitive means parallel-connected to a load which is in turn connected to a supply voltage;

a transconductor interposed between said supply voltage and said load and whose output voltage supplies said load;

differential amplifier means coupled between the output of said transconductor and the supply voltage, and further coupled to the input of said transconductor;

second capacitive means coupled between said supply voltage and the input of said transconductor; and a pair of diodes coupled to the output of said transconductor and to said first capacitive means and configured to introduce a zero in the transfer function of said voltage regulator that is suitable to compensate for a pole generated by said first capacitive means.

2. The circuit according to claim 1 wherein the diodes of said pair of diodes are parallel-connected, said diodes having mutually opposite polarities.

3. The circuit according to claim 1 wherein said differential amplifier means are connected, by means of one input of a pair of inputs, to a common node between the output of said transconductor and said pair of diodes, and are connected to the supply voltage by means of the other input of said pair of inputs.

4. The circuit according to claim 1 wherein said differential amplifier means have a high gain and a limited output current.

5. The circuit according to claim 1 wherein said first capacitive means are connected between said pair of diodes and ground.

6. The circuit according to claim 1 wherein said second capacitive means are connected between a first input of said transconductor and the power supply voltage, a second input of said transconductor being connected to the power supply voltage.

7. A voltage regulation circuit, comprising:

a transconductor having a first input, a second input, and an output, the first input coupled to a voltage supply, and the output coupled to a first terminal of a load;

a pair of diodes coupled to the output of the transconductor and to a first terminal on a first capacitor, the pair of diodes configured to introduce a zero in the transfer function of the regulator to offset a pole introduced by the first capacitor;

an amplifier having a first input, a second input, and an output, the first input coupled to the transconductor output, the second input coupled to the voltage supply, and the output coupled to the second input of the transconductor; and a second capacitor having a first terminal coupled to the voltage supply and a second terminal coupled to the second input of the transconductor.

8. The regulator of claim 7 wherein the first capacitor and the load each have second terminals coupled to a common node.

9. The regulator of claim 8 wherein the amplifier is configured as a high-gain differential amplifier with limited current output.

10. The regulator of claim 8 wherein the pair of diodes are mutual parallel connected.

11. A voltage regulator for an integrated circuit having a voltage supply and a load connected to a common node, the regulator comprising:

a transconductor having a first input coupled to the voltage supply through a first node, a second input coupled to a second node, and an output coupled to a third node;

an amplifier having a first input coupled to the third node, a second input coupled to the first node, and an output coupled to the second node;

a pair of diodes having a first common terminal coupled to the third node and a second common terminal coupled to a first terminal of a first capacitor, the pair of diodes configured to introduce a zero in the transfer function of the regulator to offset a pole introduced by the first capacitor; and a second capacitor having a first terminal coupled to the first node and a second terminal coupled to the second node.

12. The regulator of claim 11 wherein the pair of diodes are configured to have the anode of a first diode and the cathode of a second diode connected to the first common terminal and the cathode of the first diode and the anode of the second diode connected to the second common terminal.

13. The regulator of claim 12 wherein the amplifier is configured as a high-gain differential amplifier with limited current output.

14. The regulator of claim 12, further comprising a negative-feedback voltage loop connected between the first node and the second input of the amplifier.

15. The regulator of claim 14 wherein the negative-feedback voltage loop comprises a voltage source having a negative terminal connected to the second input of the amplifier and a positive terminal connected to the second input of the amplifier and a positive terminal connected to the first node.

* * * * *